US006460357B1

(12) United States Patent
Doi et al.

(10) Patent No.: US 6,460,357 B1
(45) Date of Patent: Oct. 8, 2002

(54) TWO-EVAPORATOR REFRIGERATOR HAVING A BYPASS AND CHANNEL-SWITCHING MEANS FOR REFRIGERANT

(75) Inventors: Takashi Doi; Tsutomu Sakuma; Koji Kashima; Akihiro Noguchi, all of Tokyo (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 10/012,353

(22) Filed: Dec. 12, 2001

(30) Foreign Application Priority Data

Dec. 12, 2000 (JP) ..... 2000-377897

(51) Int. Cl.[7] ..... F25B 5/00; F25B 1/00

(52) U.S. Cl. ..... 62/199; 62/228.5; 62/510

(58) Field of Search ..... 62/113, 228.5, 62/199, 335, 510, 512, 513

(56) References Cited

U.S. PATENT DOCUMENTS 4,513,581 A * 4/1985 Mizobuchi et al. ..... 62/197
4,918,942 A 4/1990 Jaster
5,056,328 A * 10/1991 Jaster et al. ..... 62/180
5,261,247 A * 11/1993 Knezic et al. ..... 62/117
5,465,591 A * 11/1995 Cur et al. ..... 62/439

FOREIGN PATENT DOCUMENTS

JP 5-26526 * 2/1993 ..... 62/510
JP 4-32663 * 2/1994 ..... 62/510

* cited by examiner

*Primary Examiner*—Denise L. Esquivel
*Assistant Examiner*—Melvin Jones
(74) *Attorney, Agent, or Firm*—Pillsbury Winthrop LLP

(57) ABSTRACT

A refrigerator has a two-stage compressor and means for switching refrigerant flow between a primary channel and a bypassing channel at downstream of a condenser that is connected with an outlet of the two-stage compressor. The primary channel extends from a first exit of the means for switching, through a first capillary tube and a first evaporator, to a gas-liquid separator, a gas-exit of which is connected with a second evaporator through a second capillary tube. The bypassing channel extends from a second exit of the means for switching, through a bypass capillary, to the gas-liquid separator. When flow of refrigerant in the second evaporator is substantially interrupted and so detected, refrigerant flow is switched to the bypassing channel, by means for controlling.

12 Claims, 8 Drawing Sheets

Fig. 1 1ST EMBODIMENT 10

2ND EMBODIMENT
10

12
14
15
16
18
19
20
22
24
25
26
27
28
TEMP.SENSOR
32

TWO-EVAPORATOR REFRIGERATOR HAVING A BYPASS AND CHANNEL-SWITCHING MEANS FOR REFRIGERANT

BACKGROUND OF THE INVENTION

This invention relates to a refrigerator equipped with a two-stage compressor and two evaporators for performing a refrigeration cycle.

Such a refrigerator has been proposed and described in U.S. Pat. No. 4,918,942.

The refrigeration cycle of the prior art document comprises following steps; each of the steps will be explained by referring FIG. 8, which shows a refrigerant circuit 100.

(1) Gaseous refrigerant streams out at high pressure from an outlet of the two-stage compressor. Then, the gaseous refrigerant is condensed at interior of a condenser 14 to become a two-phase refrigerant composed of gas and liquid phases at high pressure.

(2) The two-phase refrigerant at high pressure is subjected to pressure reduction in a capillary tube 16'. Then, the two-phase refrigerant at intermediate pressure flows into an evaporator 18 for fresh food compartments or non-freezing refrigerator compartment (hereinafter referred as "fresh food evaporator").

(3) Liquid-phase part of the two-phase refrigerant partly evaporates at inside of the fresh food evaporator 18. Then, the two-phase refrigerant enters into a separator 20', through which gas-phase and liquid-phase parts are separated from each other.

(4) Gaseous refrigerant that is separated from liquid refrigerant by the separator 20' flows through a suction pipe 22 at intermediate pressure; and then returns to the two-stage compressor 12 through its intermediate-pressure side inlet.

(5) Liquid refrigerant that is separated from the gaseous refrigerant by the separator 20' is subjected to pressure reduction at a throttle valve 114, to form a two-phase refrigerant at low pressure. Then, the two-phase refrigerant at low pressure flows into an evaporator 26 for freezer compartment (hereinafter referred as "freezer evaporator").

(6) Liquid part of the two-phase refrigerant evaporates in the freezer evaporator 26. Thus formed gaseous refrigerant flows through a suction pipe 28 at low pressure; and then returns to the two-stage compressor 12 through its low-pressure side inlet.

The prior art refrigeration cycle has a problem of occasional occurrence of so-called "one-sided flow" and resulting interruption of cooling of the freezer compartment. The "none-sided flow" means undesirable interruption of refrigerant flow in the freezer evaporator 26 while refrigerant continues to flow through the other passage in the refrigerant circuit. In other words, whole of refrigerant taken into the separator 20' flows out to the suction pipe 22 at intermediate pressure, and then into the intermediate-pressure side inlet of the compressor 12. The "one-sided flow" occurs when a pressure balance between the fresh food evaporator 18 and the freezer evaporator 26 is lost. The "one-sided flow" does occur especially when heat-exchange temperature of the freezer evaporator 26 rises too high at occasion of excessive rise of temperature in the freezer compartment.

Meanwhile, at occasion of dropped room temperature in winter season or the like, no cooling at the fresh food evaporator 18 is needed while need of cooling at the freezer evaporator 26 still remains. The prior art refrigeration cycle also has a problem in such occasion. Because the fresh food evaporator 18 and the freezer evaporator 16 are connected in serial, refrigerant also have to flow through the fresh food evaporator 18.

The "one-sided flow" also occurs when an excessive cooling or heat exchange is made by the fresh food evaporator 18, because such excessive heat exchange makes liquid-phase refrigerant entirely evaporates in the fresh food evaporator 18 and thus exhausting the liquid-phase refrigerant that is in otherwise to be sent to the freezer evaporator 26.

BRIEF SUMMARY OF THE INVENTION

First aspect of invention-wise refrigerator comprising: a two-stage compressor having an outlet and first and second inlets, pressure of said fist inlet being intermediate between pressures of the outlet at higher pressure and the second inlet at lower pressure; means for switching of refrigerant flow channels at downstream of a condenser connected with said outlet; means for separating gaseous and liquid phase parts of refrigerant from each other at downstream of a first evaporator for fresh food compartment, said first evaporator being connected from first exit of said means for switching through a first capillary tube; a first suction pipe connecting from a gaseous part exit of said means for separating to said first inlet of the two-stage compressor; a second capillary tube connecting from a liquid part exit of said means for separating to a second evaporator for freezer compartment; a bypass capillary tube connecting to the second evaporator from second exit of said means for switching; a second suction pipe connecting from the second evaporator to said second inlet of the two-stage compressor; and means for controlling a refrigeration cycle in a manner of bypassing or skipping the first evaporator when temperatures of said first suction pipe becomes lower than a predetermined value, by closing said first exit of the means for switching and by opening said second exit of the means for switching.

According to second aspect of the invention, said bypassing is made when temperature of the second suction pipe becomes higher than a predetermined value, alternative to that of the first aspect of the invention—bypassing is made when the temperatures of said second suction pipe becomes lower than a predetermined value.

According to third aspect of the invention, said bypassing is made when temperature of the means for separating becomes lower than a predetermined value, alternative to those of former aspects of the invention.

According to fourth aspect of the invention, said bypassing is made when temperatures of the means for separating and the second evaporator being become substantially same, alternative to those of former aspects of the invention.

According to fifth aspect of the invention, said bypassing is made when drive frequency of a motor for operating said two-stage compressor increases to a predetermined magnification, alternative to those of former aspects of the invention.

According to sixth aspect of the invention, a fan for leading air around said first evaporator into the fresh food compartment is driven at a time of said bypassing by said means for controlling.

A normal mode of refrigeration cycle of the refrigerator is explained in below.

(1) Gaseous refrigerant streams out at high pressure from an outlet of a two-stage compressor, and is condensed in a condenser to form a two-phase refrigerant composed of gaseous and liquid phases.

(2) The two-phase refrigerant of high pressure is subjected to pressure reduction within a first capillary tube to become a two-phase refrigerant of intermediate pressure; and then flows into a first evaporator for cooling a fresh food compartment.

(3) Liquid part of the two-phase refrigerant partly evaporates in the first evaporator. Then, the two-phase refrigerant flows into means for separating gaseous and liquid parts of refrigerant from each other.

(4) Gaseous refrigerant that is separated from liquid refrigerant by the means for separating returns directly through a first suction pipe into the two-stage compressor from its first inlet. The first inlet is at an intermediate pressure between pressures at outlet and second inlet of the two-stage compressor.

(5) Liquid refrigerant that is separated from the gaseous refrigerant by the separator flows through a second capillary tube as being reduced in pressure to become a two-phase refrigerant; then the two-phase refrigerant at lower pressure flows into a second evaporator for cooling a freezer compartment.

(6) Liquid part of the two-phase refrigerant evaporates in the freezer compartment. Thus formed gaseous refrigerant returns, through a second suction pipe at pressure lower than that of the first suction pipe, into the two-stage compressor 12 from its second inlet.

The invention-wise refrigerator operates not only in normal mode but also in "bypassing" mode of refrigeration cycle as in below.

According to the first aspect of the invention, occurring of "one-sided flow" is assumed when temperature of the first suction pipe exceeds a predetermined temperature. In such occasion, the first exit of the switching means is closed while the second exit of the switching means is opened, thereby bypassing refrigerant directly to the second evaporator for the freezer compartment while skipping the first evaporator for the fresh food compartment. In this way, the "one-sided flow" is prevented or quenched by directly providing refrigerant to the second evaporator, and thus cooling of the freezer compartment being effected.

According to the second aspect of the invention, the "one-sided flow" is detected by temperature of the second suction pipe, pressure in which is lower than that of the first suction pipe. Meanwhile, the "one-sided flow" is detected by: temperature of the separating means in the third aspect of the invention; by temperature difference between the separating means and the first evaporator in the fourth aspect of the invention; by drive frequency of a motor for operating the two-stage compressor in the fifth aspect of the invention.

DETAILED DESCRIPTION OF THE INVENTION

First Embodiment

Figure 1:
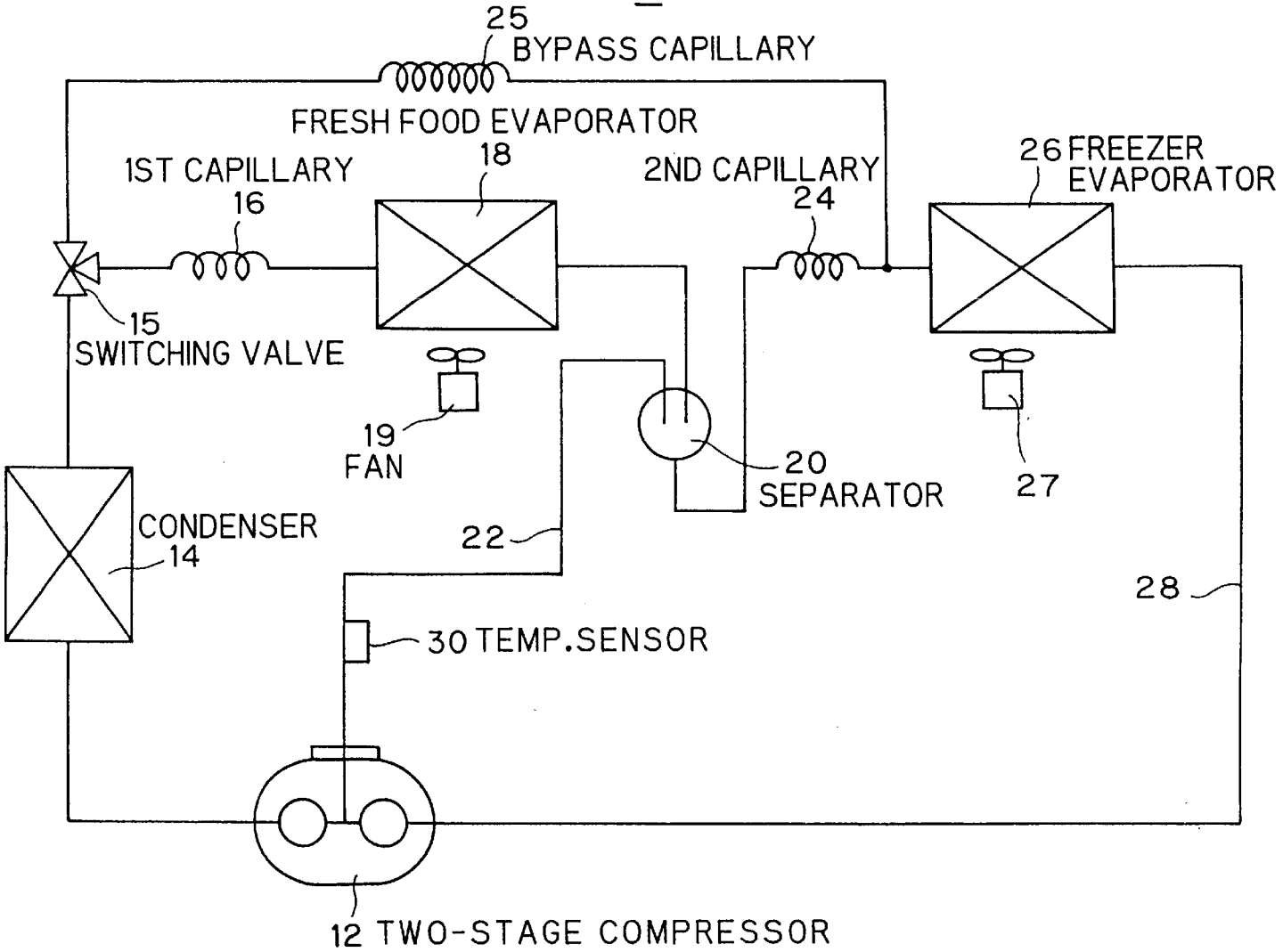
FIG. 1 shows construction of a refrigerant circuit of first embodiment.
Figure 2:
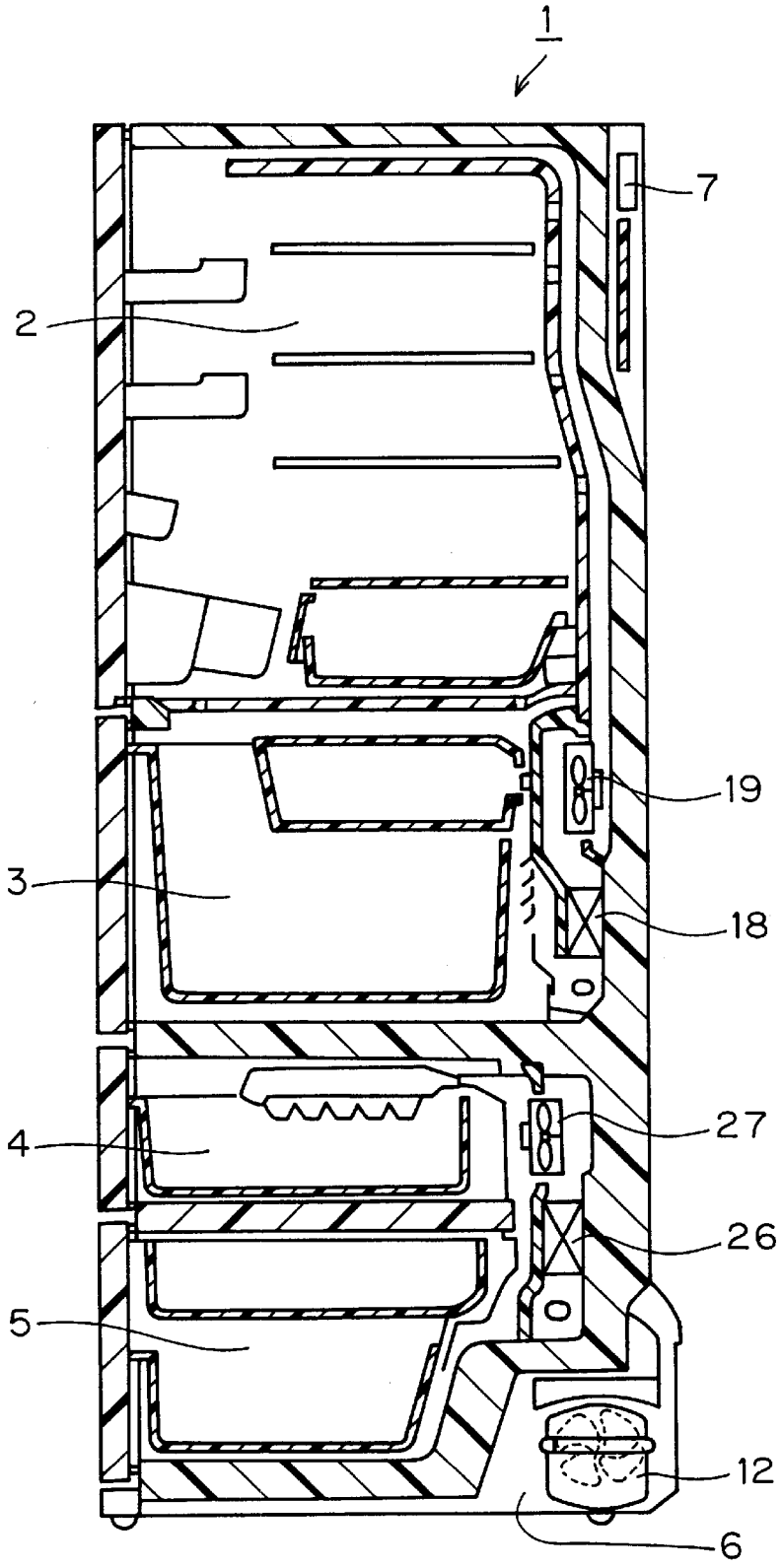
Fig.2 Prior Art
FIG. 2 shows a vertical sectional view of a refrigerator.

The first embodiment of the present invention will be described with reference to FIGS. 1 through 3. FIG. 1 shows construction of a refrigerant circuit of first embodiment; and FIG. 2 shows a vertical sectional view of a refrigerator.

1. Structure of a Refrigerator

On first hand, a structure of a refrigerator is explained with reference to the FIG. 1. At inside of a refrigerator 1, there are arranged a fresh food compartment 2, a vegetable compartment 3, an ice-forming compartment 4 and a freezer compartment 5, in serial in this order from upside to down. At backside of the refrigerator 1, a machinery compartment 6 is arranged with a two-stage compressor 12 (hereinafter merely referred as "compressor").

At backside of the ice-forming compartment 4, a freezer evaporator 26, or an evaporator for freezing, is disposed for cooling the ice-forming compartment 4 and the freezer compartment 5. Further, at backside of the vegetable compartment 3, a fresh food evaporator 18, or an evaporator for non-freezing refrigeration, is disposed for cooling the fresh food compartment 2 and the vegetable compartment 3.

At upside of the freezer evaporator 26, first fan 27 is disposed for sending out an air cooled by the freezer evaporator 26 into the ice-forming compartment 4 and the freezer compartment 5. Further, at upside of the fresh food evaporator 18, second fan 19 is disposed for sending out an air cooled by the fresh food evaporator 18 into the fresh food compartment 2 and the vegetable compartment 3.

A controller section 7 formed of a microcomputer is arranged at backside of top-plate part in the refrigerator 1.

2. Construction of the Refrigerant Circuit 10

Construction of the refrigerant circuit 10 in a refrigerator 1 is explained with reference to the FIG. 1.

A compressor 12 has an exit at higher-pressure side of the circuit that is connected to a condenser 14. The condenser 14 is then connected to a three-way valve 15 having a first exit, which is connected with a first capillary 16 at higher-pressure side and which is further connected therethrough with the fresh food evaporator 18.

An exit of the fresh food evaporator 18 is connected to a refrigerant inlet of a gas-liquid separator 20. A gas-exit pipe of the gas-liquid separator 20 is connected with a first suction pipe 22 and further connected therethrough with an intermediate-pressure-side inlet of the compressor 12. Meanwhile, a liquid-exit pipe of the gas-liquid separator 20 is connected to an end of second capillary tube 24, pressure in which is lower than the first capillary tube 16. Moreover, the second exit of the above-mentioned three-way valve 15 is connected with an end of a bypass capillary 25 while the other end of the bypass capillary 25 and the other end of the second capillary 24 are connected to an end of the freezer evaporator 26. The other end of the freezer evaporator 26 is connected to lower-pressure-side inlet of the compressor 12, through a second suction pipe 28.

The first suction pipe 22 is equipped with a temperature sensor 30 for detecting a temperature of the pipe. The temperature sensor 30 is electrically connected to the controller section 7 that operates opening and closing of the first and second exit of the three-way valve 15.

3. Operation of the refrigerant circuit 10—refrigeration cycle

Normal mode of operation of the above-explained refrigerant circuit 10 is explained in following. In the normal mode, the controller section 7 makes the first exit of the three-way valve 15 as opened and the second exit of the valve as closed.

(1) Gaseous refrigerant is compressed in the compressor 12 and outputted from an outlet of the compressor 12 at high pressure.

(2) The gaseous refrigerant at high pressure is condensed at interior of a condenser 14 to be outputted as a two-phase refrigerant composed of gas and liquid phases at high pressure, and then flows into the three-way valve 15.

(3) The two-phase refrigerant at high pressure is subjected to pressure reduction in the first capillary tube 16. Then, the two-phase refrigerant of intermediate pressure flows into the fresh food evaporator 18.

(4) Liquid-phase part of the two-phase refrigerant partly evaporates at inside of the fresh food evaporator 18. Then, the two-phase refrigerant enters into the gas-liquid separator 20, through which gas-phase and liquid-phase parts are separated from each other.

(5) Gaseous refrigerant that is separated from liquid refrigerant at the interior of the separator 20 flows through a suction pipe 22 at intermediate pressure; and such intermediate-pressure gaseous refrigerant flows to the two-stage compressor 12 through its intermediate-pressure side inlet to be mixed with refrigerant at lower pressure.

(6) Liquid refrigerant that is separated from the gaseous refrigerant by the separator 20 is subjected to pressure reduction at the second capillary tube 24, to form a two-phase refrigerant at low pressure. Then, the two-phase refrigerant at low pressure flows into the freezer evaporator 26.

(7) Liquid part of the two-phase refrigerant evaporates in the freezer evaporator 26 to form a gaseous refrigerant.

(8) The gaseous refrigerant flowing out from the freezer evaporator 26 flows through a suction pipe 28 at low pressure; and such low-pressure gaseous refrigerant returns to the two-stage compressor 12 through its low-pressure side inlet.

(9) In the compressor 12, the low-pressure gaseous refrigerant is compressed at a lower-pressure side compartment of the compressor 12 to an intermediate pressure; then added and mixed with the intermediate-pressure gaseous refrigerant that is taken in from the intermediate-pressure side inlet; and further compressed in a higher-pressure side compartment of the compressor 12 to be outputted at high pressure from the exit.

4. Prevention of the One-sided Flow

The one-sided flow may occur during the above operation of the refrigeration cycle. Operation for preventing or quenching of the one-sided flow is explained as follows.

As mentioned in the Background of the Invention, the one-sided flow means a state where refrigerant flows not through the freezer evaporator 26 and only through a channel connecting the fresh food evaporator 18, the gas-liquid separator 20, the first suction pipe 22 and the compressor 12 in serial in this order.

Figure 3A:
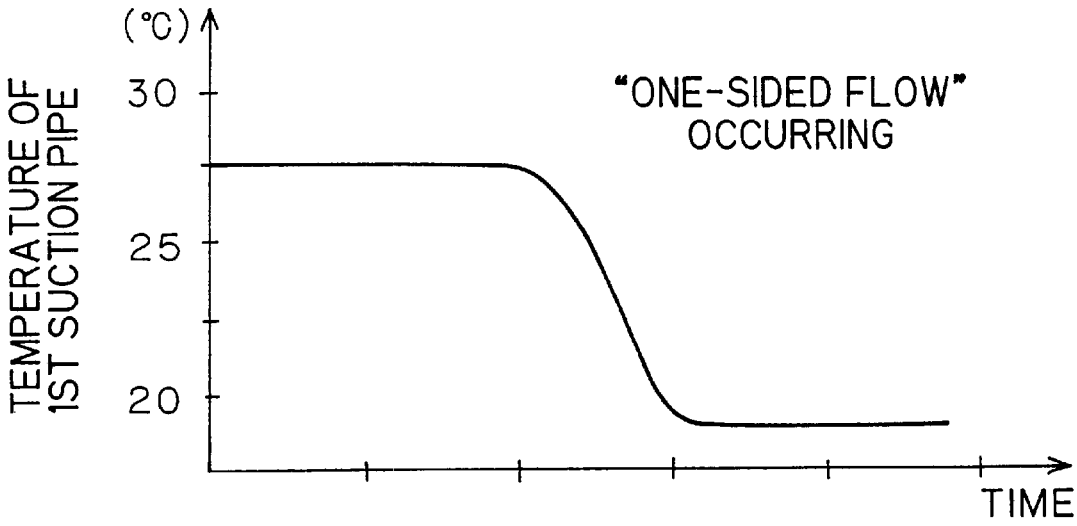
FIG. 3A is a graph showing a temperature variation of a first suction pipe at intermediate pressure, upon occasion of the one-sided flow.

On the occasion of occurring of the one-sided flow, temperature of the first suction pipe 22 is found to become lower than usual, as illustrated in FIG. 3A, by our investigation.

In this embodiment, if a temperature detected by the temperature sensor 30 attached onto the first suction pipe 22 become 25° C. or lower, the controller section 7 operates as to close the first exit of the three-way valve 15 and open the second exit of the three-way valve 15. As a result, the refrigerant flows not into the fresh food evaporator 18 and flows through the bypass capillary tube 25 and directly into the freezer evaporator 26. Such an operation of the refrigerant circuit is to be referred as bypassing operation. By the bypassing operation, a cooling at the freezer evaporator 26 takes place in a such a manner to prevent temperature rise at the freezer evaporator 26 that is the case in the prior art at occasion of the one-sided flows.

Figure 3B:
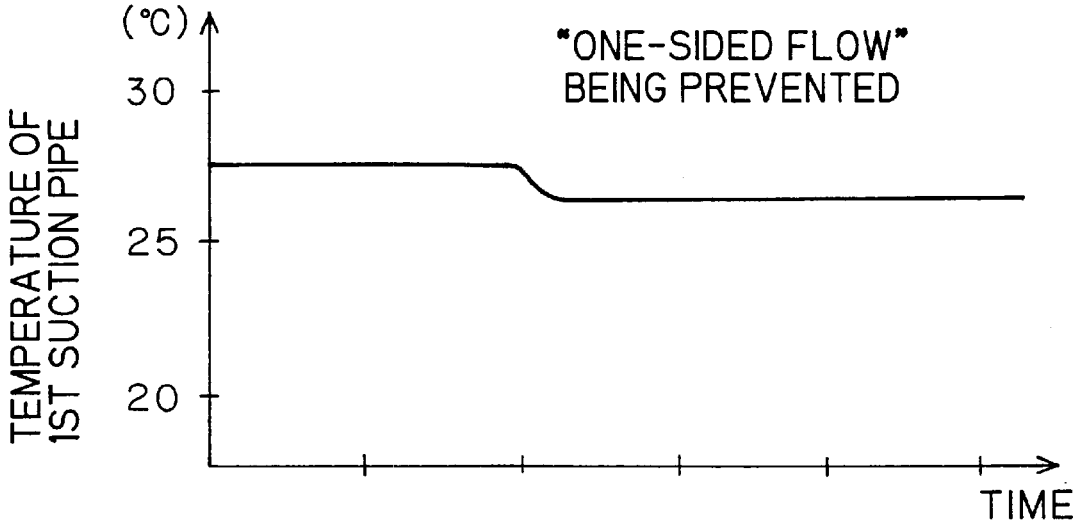
FIG. 3B is a graph showing a temperature variation of the first suction pipe at intermediate pressure at a time of no occurrence of the one-sided flow.

FIG. 3B shows a graph illustrating a temperature variation curve of the first suction pipe 22 observed when the bypassing operation is performed. As shown in the figure, temperature of the first suction pipe 22 is kept higher than the value of 25° C. as to prevent the one-sided flow.

The bypassing operation is adopted not only when to prevent or quench the one-sided flows, but also when cooling is needed only at the freezer evaporator 26 and not at the fresh food evaporator 28 because of dropped room temperature in winter season or the like. If the refrigerant channel is switched to the bypass capillary 25 that is directly connected to the freezer evaporator 26 in such bypassing operation, cooling is made only at the freezer evaporator 26.

Moreover, the bypassing operation will be also adopted to conduct cooling at the freezer evaporator 26 in following occasion; when excessive cooling load is applied on the fresh food evaporator 18, evaporation of the liquid part of the refrigerant is completed in the fresh food evaporator 18 as to disrupt flowing of refrigerant to the freezer evaporator 26.

Second Embodiment

Figure 4:
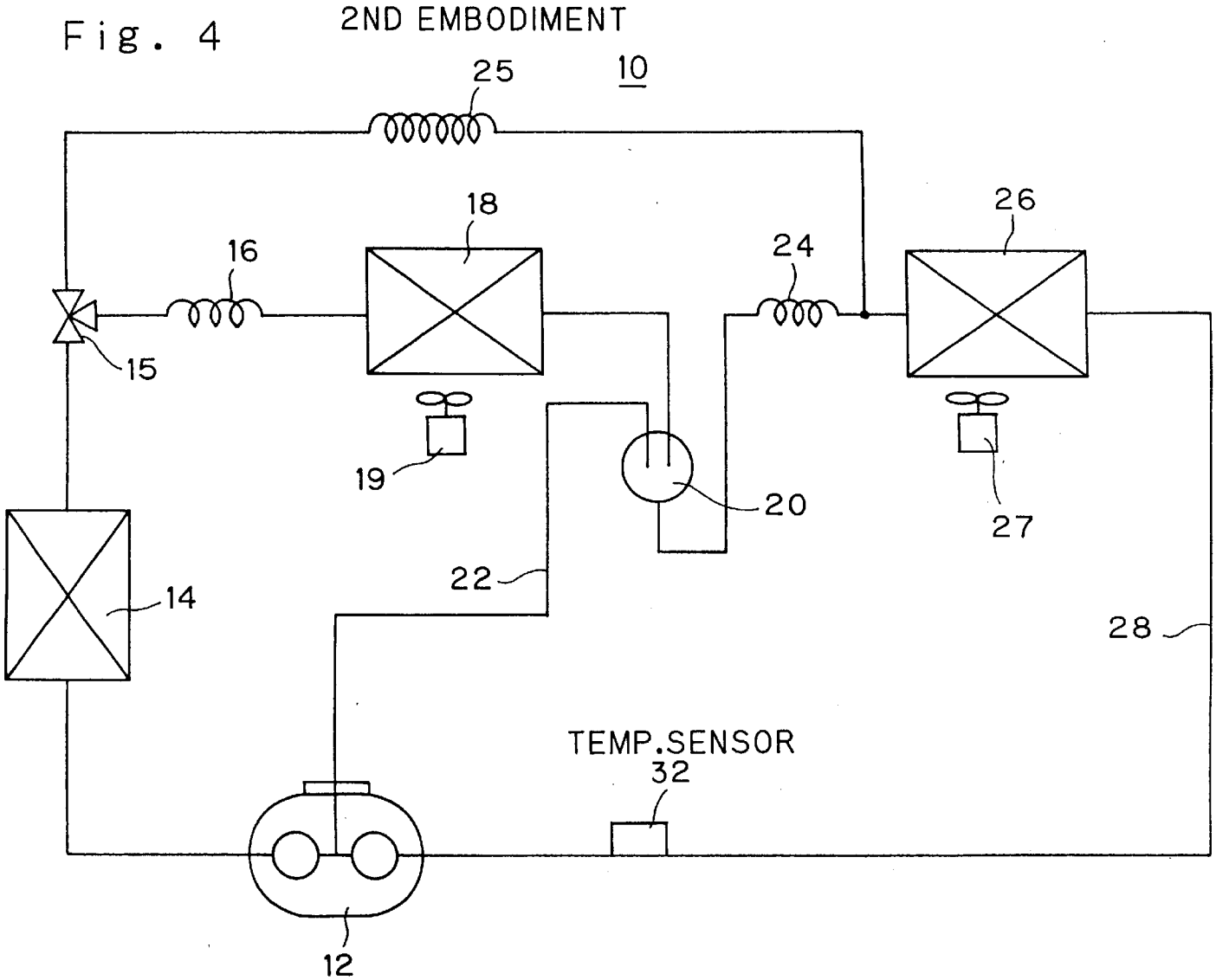
FIG. 4 shows construction of a refrigerant circuit of second embodiment.
Figure 5A:
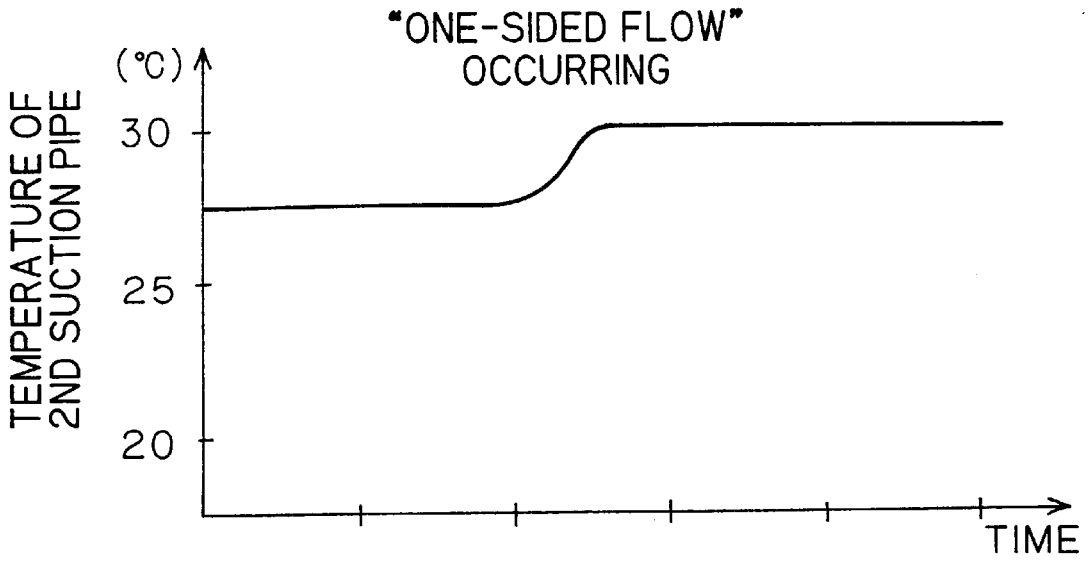
FIG. 5A is a graph showing a temperature variation of a low-pressure suction pipe at an occasion of the one-sided flow.
Figure 5B:
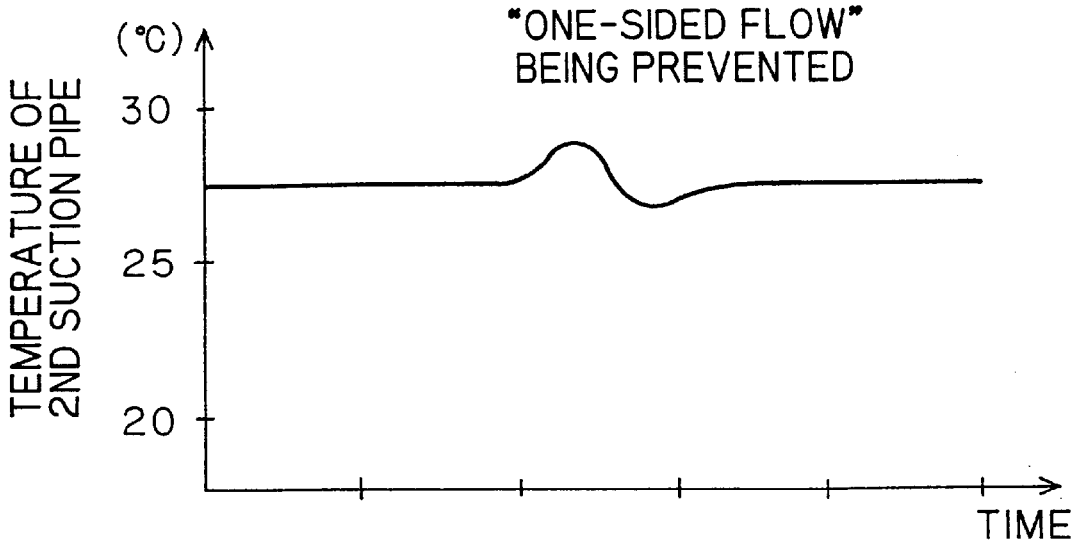
FIG. 5B is a graph showing a temperature variation of a low-pressure suction pipe at a time of no occurrence of the one-sided flow.

The second embodiment of the present invention will be described with reference to FIGS. 4, 5A and 5B.

This embodiment differs from the first embodiment in manner of detecting occurrence of the one-sided flow as follows: temperature variation of the second suction pipe 28, which is at pressure lower than that of the first suction pipe 22, is monitored to determine whether the one-sided flow is in a state or not; it is noted that in the above first embodiment, on contrary, the temperature variation of the second suction pipe 22 is monitored.

It is found that the one-sided flow is in a state of operation of the refrigeration cycle if and only if the temperature of the second suction pipe 28 exceeds 27° C. Thus, temperature sensor 32 is attached on the second suction pipe 28; when the detected temperature becomes 28° C. or more, occurrence of the one-sided flow is assumed; and based on such assumption, the bypassing operation is conducted (FIG. 5B).

Third Embodiment

Figure 6:
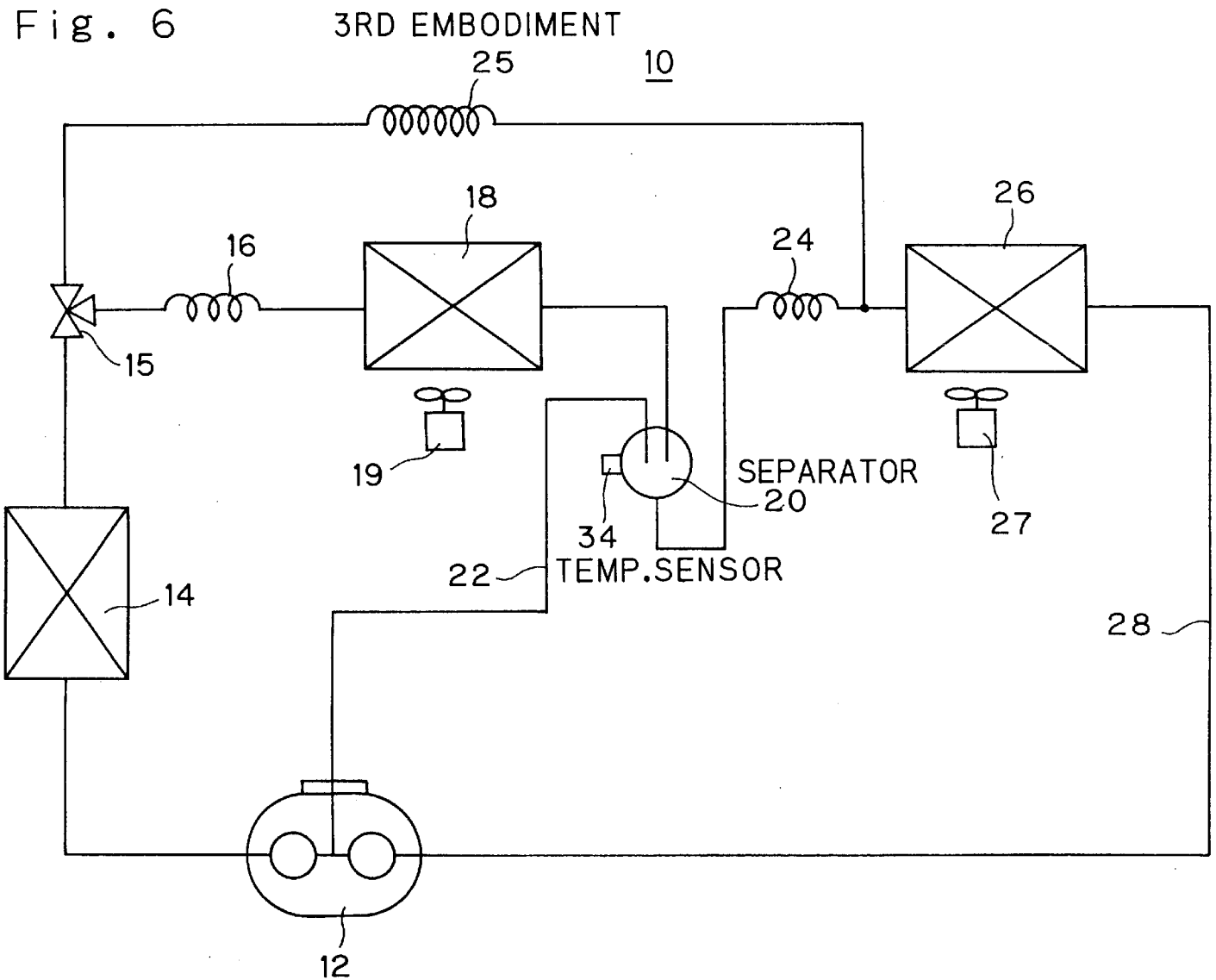
FIG. 6 shows construction of a refrigerant circuit of third embodiment.

The third embodiment of the present invention will be described with reference to FIGS. 6, 7A and 7B.

This embodiment differs from the first embodiment in manner of detecting occurrence of the one-sided flow as follows: temperature variation of the gas-liquid separator 20 is monitored to detect the one-sided flow.

Figure 7A:
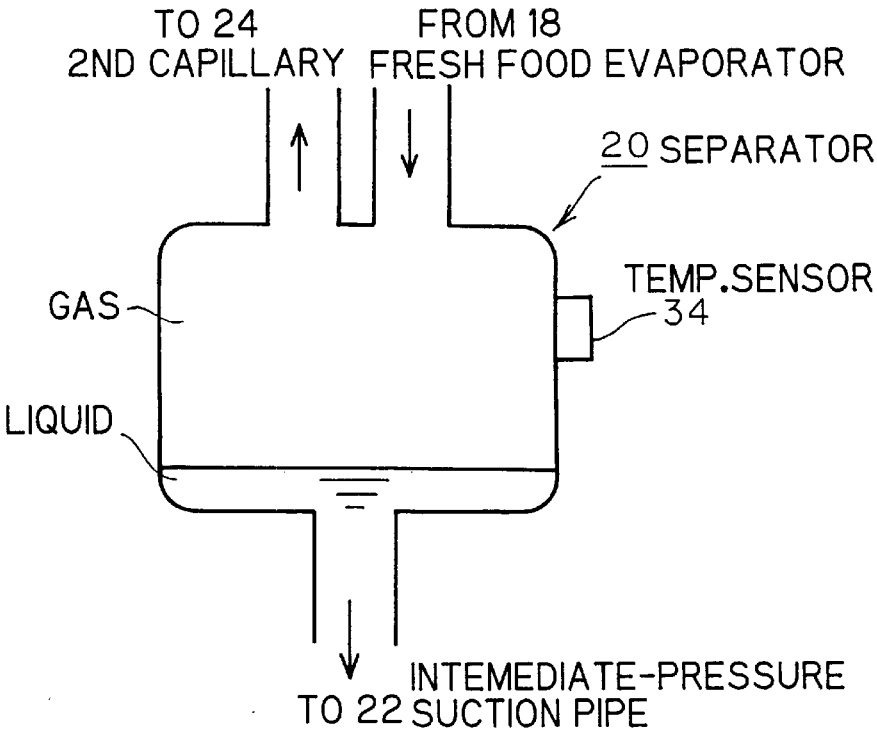
FIG. 7A is an explanatory illustration of a gas-liquid separator in a normal state at a time of no occurrence of the one-sided flow.
Figure 7B:
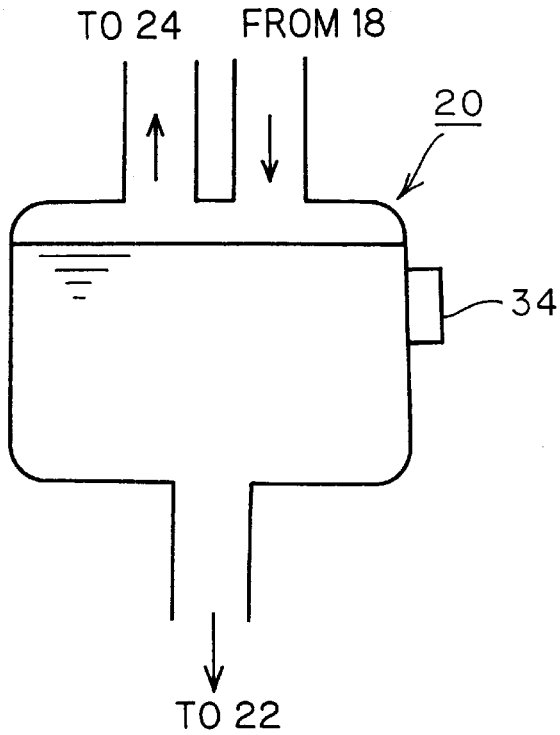
FIG. 7B is an explanatory illustration of a gas-liquid separator at an occasion of the one-sided flow.
Figure 8:
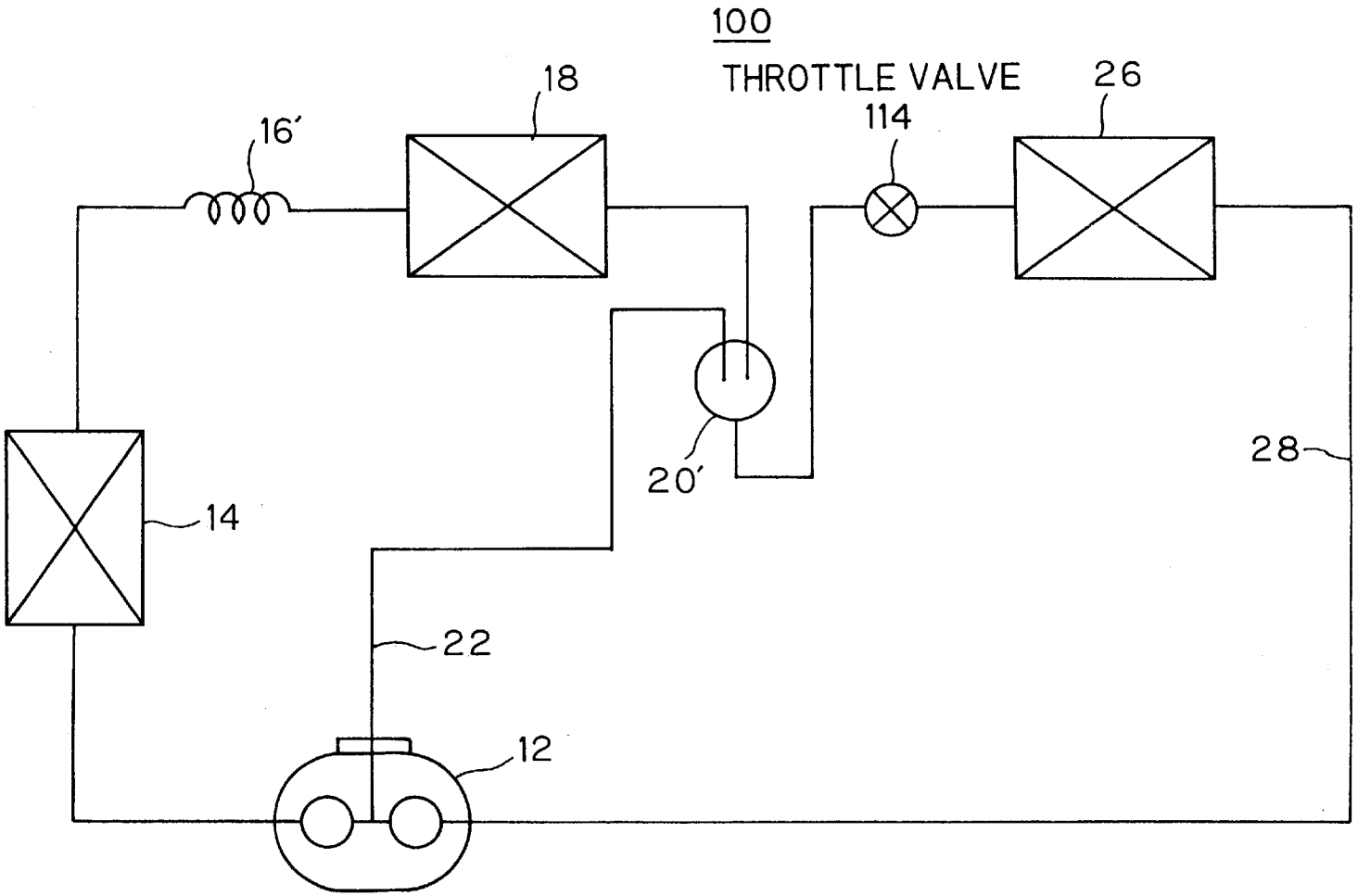
Fig. 8 Prior Art
FIG. 8 shows construction of a refrigerant circuit in the prior art.

As shown in the FIG. 7A, interior of the separator 20 is almost filled with gaseous refrigerant in normal state, thereby keeping the temperature of the separator 20 as stable, for example, at about −2° C. If the one-sided flow occurs, the interior of the separator 20 becomes to be filled with liquid refrigerant as shown in FIG. 7B, and in same time, the temperature of the separator 20 drops, for example, to −3° C.

In view of this, a temperature sensor 34 is attached on the gas-liquid separator 20; when the detected temperature becomes −3° C., occurrence of the one-sided flow is assumed; and based on such assumption, the bypassing operation is conducted.

Fourth Embodiment

The fourth embodiment of the present invention will be described.

This embodiment differs from the first embodiment also in manner of detecting occurrence of the one-sided flow as follows: temperature difference between the fresh food evaporator 18 and the gas-liquid separator 20 is monitored to detect the one-sided flow. Specifically, temperature sensors are disposed to detect evaporation temperature of the fresh food evaporator 18 and surface of the gas-liquid separator 20.

In normal state, interior of the separator 20 is kept at pressure same with interior of the fresh food evaporator 18 while no evaporation proceeds in the separator 20. For this reason, temperature of the interior of the separator 20 is easily affected by outside and is kept higher than that of the fresh food evaporator by about 1° C. For example, temperature of the fresh food evaporator 18 is kept at −3° C. while temperature of the gas-liquid evaporator 20 is kept at −2° C.

At occurrence of the one-sided flow, the interior of the separator 20 becomes filled with liquid refrigerant, and the temperature of the separator 20 becomes equal to the temperature of the fresh food evaporator 18, for example, to −3° C. Thus, when the detected temperatures become equal, occurrence of the one-sided flow is assumed; and based on such assumption, the bypassing operation is conducted.

Fifth Embodiment

The fifth embodiment of the present invention will be described, which also differs from the first embodiment in manner of detecting occurrence of the one-sided flow.

Because the one-sided flow is derived from imbalance of load, due to opening and closing of door of the refrigerant for example, such imbalance causes increase of drive frequency of the compressor 12 in a motion to compensate such imbalance of load. Thus, when the increasing of the drive frequency is detected, the bypassing operation is conducted. For example, if the compressor 12 has been operated at frequency of 30 Hz and starts to be operated at frequency of 45 Hz, or 1.5 times of the 30 Hz, the occurrence of the one-sided flow is assumed; and based on such assumption, the bypassing operation is conducted.

Other Modifications

In each of the hereto-mentioned embodiments, the by passing operation is conducted at every occurrence of the one-sided flow, as to effect enough cooling at the freezer evaporator 26. However, the bypassing operation is not needed if the cooling capacity of the freezer evaporator 26 is sufficiently large and cooling is needed only at the fresh food evaporator 18. In such a circumstance, the one-sided flow is not always troublesome. Thus, at sometimes, the bypassing operation may be skipped. For example, the bypassing operation will be skipped, even at occurrence of the one-sided flow, when temperature of the fresh food evaporator 18 is higher than normal and temperature of the freezer evaporator 26 is lower than normal.

In otherwise, frost removing may be made as follows.

Because refrigerant continuously flows through the fresh food evaporator 18 and the freezer evaporator 26 in the refrigerant circuit 10, frost may be deposited onto the fresh food evaporator 18. Meanwhile, at the bypassing operation, refrigerant does not flow through the fresh food evaporator 18.

In view of the above, the bypassing operation is conducted while operating the first fan 27 for sending air around the fresh food evaporator 18. By such airflow, the frost on the fresh food evaporator 18 is removed.

Additionally, by such a way, the refrigerant filled in the fresh food evaporator 18 is sent to the freezer evaporator 26, to enhance cooling ability of the freezer evaporator 26.

CROSS-REFERENCE TO RELATED APPLICATIONS

This application is based upon and claims the benefits of priority from the prior Japanese Patent Applications No. 2000-377897 filed on Dec. 12, 2000; the contents of which are incorporated herein by reference.

What is claimed is:

1. A refrigerator comprising:

a two-stage compressor having an outlet and first and second inlets, pressure of said first inlet being intermediate between pressures of the outlet at higher pressure and the second inlet at lower pressure;

means for switching of refrigerant flow channels at downstream of a condenser connected with said outlet;

means for separating gaseous and liquid phase parts of refrigerant from each other at downstream of a first evaporator for fresh food compartment, said first evaporator being connected from first exit of said means for switching through a first capillary tube;

a first suction pipe connecting from a gaseous part exit of said means for separating to said first inlet of the two-stage compressor;

a second capillary tube connecting from a liquid part exit of said means for separating to a second evaporator for freezer compartment;

a bypass capillary tube connecting to the second evaporator from second exit of said means for switching;

a second suction pipe connecting from the second evaporator to said second inlet of the two-stage compressor; and means for controlling a refrigeration cycle in a manner of bypassing the first evaporator when temperatures of said first suction pipe becomes lower than a predetermined value, by closing said first exit of the means for switching and by opening said second exit thereof.

2. A refrigerator comprising:

a two-stage compressor having an outlet and first and second inlets, pressure of said first inlet being intermediate between pressures of the outlet at higher pressure and the second inlet at lower pressure;

means for switching of refrigerant flow channels at downstream of a condenser connected with said outlet;

means for separating gaseous and liquid phase parts of refrigerant from each other at downstream of a first evaporator for fresh food compartment, said first evaporator being connected from first exit of said means for switching through a first capillary tube;

a first suction pipe connecting from a gaseous part exit of said means for separating to said first inlet of the two-stage compressor;

a second capillary tube connecting from a liquid part exit of said means for separating to a second evaporator for freezer compartment;

a bypass capillary tube connecting to the second evaporator from second exit of said means for switching;

a second suction pipe connecting from the second evaporator to said second inlet of the two-stage compressor; and means for controlling a refrigeration cycle in a manner of bypassing the first evaporator when the temperatures of said second suction pipe becomes higher than a predetermined value, by closing said first exit of the means for switching and by opening said second exit thereof.

3. A refrigerator comprising:

a two-stage compressor having an outlet and first and second inlets, pressure of said first inlet being intermediate between pressures of the outlet at higher pressure and the second inlet at lower pressure;

means for switching of refrigerant flow channels at downstream of a condenser connected with said outlet;

means for separating gaseous and liquid phase parts of refrigerant from each other at downstream of a first evaporator for fresh food compartment, said first evaporator being connected from first exit of said means for switching through a first capillary tube;

a first suction pipe connecting from a gaseous part exit of said means for separating to said first inlet of the two-stage compressor; a second capillary tube connecting from a liquid part exit of said means for separating to a second evaporator for freezer compartment;

a bypass capillary tube connecting to the second evaporator from second exit of said means for switching;

a second suction pipe connecting from the second evaporator to said second inlet of the two-stage compressor; and means for controlling a refrigeration cycle in a manner of bypassing the first evaporator when temperature of the means for separating becomes lower than a predetermined value, by closing said first exit of the means for switching and by opening said second exit thereof.

4. A refrigerator comprising:

a two-stage compressor having an outlet and first and second inlets, pressure of said first inlet being intermediate between pressures of the outlet at higher pressure and the second inlet at lower pressure;

means for switching of refrigerant flow channels at downstream of a condenser connected with said outlet;

means for separating gaseous and liquid phase parts of refrigerant from each other at downstream of a first evaporator for fresh food compartment, said first evaporator being connected from first exit of said means for switching through a first capillary tube;

a first suction pipe connecting from a gaseous part exit of said means for separating to said first inlet of the two-stage compressor; a second capillary tube connecting from a liquid part exit of said means for separating to a second evaporator for freezer compartment;

a bypass capillary tube connecting to the second evaporator from second exit of said means for switching;

a second suction pipe connecting from the second evaporator to said second inlet of the two-stage compressor; and means for controlling a refrigeration cycle in a manner of bypassing the first evaporator when temperatures of the means for separating and the second evaporator being become substantially same, by closing said first exit of the means for switching and by opening said second exit thereof.

5. A refrigerator comprising:

a two-stage compressor having an outlet and first and second inlets, pressure of said first inlet being intermediate between pressures of the outlet at higher pressure and the second inlet at lower pressure;

means for switching of refrigerant flow channels at downstream of a condenser connected with said outlet;

means for separating gaseous and liquid phase parts of refrigerant from each other at downstream of a first evaporator for fresh food compartment, said first evaporator being connected from first exit of said means for switching through a first capillary tube;

a first suction pipe connecting from a gaseous part exit of said means for separating to said first inlet of the two-stage compressor; a second capillary tube connecting from a liquid part exit of said means for separating to a second evaporator for freezer compartment;

a bypass capillary tube connecting to the second evaporator from second exit of said means for switching;

a second suction pipe connecting from the second evaporator to said second inlet of the two-stage compressor; and means for controlling a refrigeration cycle in a manner of bypassing the first evaporator when drive frequency of a motor for operating said two-stage compressor increases to a predetermined magnification, by closing said first exit of the means for switching and by opening said second exit thereof.

6. A refrigerator according to anyone of claims 1–5, wherein a fan for leading air around said first evaporator into the fresh food compartment is driven at a time of said bypassing by said means for controlling.

7. A refrigerator comprising:

a two-stage compressor having an outlet and first and second inlets, pressure of said first inlet being intermediate between pressures of the outlet at higher pressure and the second inlet at lower pressure;

means for switching of refrigerant flow channels at downstream of a condenser connected with said outlet;

means for separating gaseous and liquid phase parts of refrigerant from each other at downstream of a first evaporator for fresh food compartment, said first evaporator being connected from first exit of said means for switching through a first capillary tube;

a first suction pipe connecting from a gaseous part exit of said means for separating to said first inlet of the two-stage compressor; a second capillary tube connecting from a liquid part exit of said means for separating to a second evaporator for freezer compartment;

a bypass capillary tube connecting to the second evaporator from second exit of said means for switching;

a second suction pipe connecting from the second evaporator to said second inlet of the two-stage compressor; and means for controlling a refrigeration cycle in a manner to detect refrigerant flow being substantially interrupted in a passage connecting from said means for separating to said second inlet through the second capillary tube, the second evaporator and the second suction pipe, and to bypass the first evaporator during such substantial interruption being detected, by closing said first exit of the means for switching and by opening said second exit thereof.

8. A refrigerator according to claim 7, wherein a fan for leading air around said first evaporator into the fresh food compartment is driven at a time of said bypassing by said means for controlling.

9. A refrigerator according to claim 7, said bypassing being made during substantially whole period of said substantial interruption.

10. A refrigerator comprising:

a two-stage compressor having an outlet and first and second inlets, pressure of said first inlet being intermediate between pressures of the outlet at higher pressure and the second inlet at lower pressure;

means for switching of refrigerant flow channels at downstream of a condenser connected with said outlet;

means for separating gaseous and liquid phase parts of refrigerant from each other at downstream of a first evaporator for fresh food compartment, said first evaporator being connected from first exit of said means for switching through a first capillary tube;

a first suction pipe connecting from a gaseous part exit of said means for separating to said first inlet of the two-stage compressor; a second capillary tube connecting from a liquid part exit of said means for separating to a second evaporator for freezer compartment;

a bypass capillary tube connecting to the second evaporator from second exit of said means for switching;

a second suction pipe connecting from the second evaporator to said second inlet of the two-stage compressor; and means for controlling a refrigeration cycle in a manner to detect refrigerant flow being substantially interrupted or smaller than a predetermined level in a passage connecting from said means for separating to said second inlet through the second capillary tube, the second evaporator and the second suction pipe, and to bypass the first evaporator during such substantial interruption or insufficient flow being detected, by closing said first exit of the means for switching and by opening said second exit thereof.

11. A refrigerator having a refrigeration cycle comprised of a normal operation and a bypassing operation, and a controller for switching the refrigeration cycle between the normal and bypassing operations, said normal operation comprises:

partly condensing gaseous refrigerant flowed out from an outlet of two-stage compressor by heat exchange to form first two-phase refrigerant composed of gas and liquid phases;

reducing pressure of the first two-phase refrigerant;

making a heat exchange by passing the first two-phase refrigerant through a first evaporator;

separating gas-phase and liquid-phase parts, of the first two-phase refrigerant flowed out from the first evaporator, from each other in a separator;

returning gaseous refrigerant flowed out from the separator to a first inlet of the two-stage compressor, while reducing pressure of liquid refrigerant flowed out from the separator to form second two-phase refrigerant having pressure lower than that of the first two-phase refrigerant in the first evaporator and subsequently making a heat-exchange by passing the second two-phase refrigerant through a second evaporator; and returning gaseous refrigerant flowed out from the second evaporator to second inlet of the two-stage compressor;

said bypassing operation being in same manner with said normal operation except that the first two-phase refrigerant formed by said partly condensing is led to the second evaporator in a manner of bypassing the first evaporator and the separator;

said controller switching the refrigerant cycle to said bypassing operation when refrigerant flow in a passage connecting the separator to said second inlet through the second evaporator is substantially interrupted.

12. A refrigerator according to claim 7 or claim 11, wherein a fan for leading air around said first evaporator into the fresh food compartment is driven at a time of said bypassing by said means for controlling.

* * * * *